United States Patent [19]

Chambers et al.

[11] Patent Number: 4,682,926

[45] Date of Patent: Jul. 28, 1987

[54] CEILING PANEL PLACING MACHINE

[75] Inventors: Sam W. Chambers, Meridian; Charles R. Spencer; Wade E. Miller, both of Boise, all of Id.

[73] Assignee: Morrison-Knudsen Company, Inc., Boise, Id.

[21] Appl. No.: 815,715

[22] Filed: Jan. 2, 1986

[51] Int. Cl.[4] ..... E04G 21/14

[52] U.S. Cl. ..... 414/11; 254/2 C; 414/590

[58] Field of Search ..... 414/10, 11, 12, 589, 414/590, 743; 405/148; 254/2 C; 269/71, 904

[56] References Cited

U.S. PATENT DOCUMENTS

| | | | |
|---|---|---|---|
| 2,613,822 | 10/1952 | Stanley | 414/743 X |
| 2,677,580 | 5/1954 | Minzenmayer | 414/10 X |
| 3,409,158 | 11/1968 | Lull | 414/11 X |
| 3,954,189 | 5/1976 | Sheritt | 414/11 |
| 3,970,200 | 7/1976 | Goetjen | 414/11 |
| 4,051,682 | 10/1977 | Lockwood | 414/11 X |
| 4,369,014 | 1/1983 | Jolivet | 414/11 |
| 4,491,449 | 1/1985 | Hawkins | 414/10 |

FOREIGN PATENT DOCUMENTS

| | | | |
|---|---|---|---|
| 2088325 | 6/1982 | United Kingdom | 254/2 C |
| 699192 | 12/1979 | U.S.S.R. | 405/148 |

*Primary Examiner*—Leslie J. Paperner

*Attorney, Agent, or Firm*—Seed and Berry

[57] ABSTRACT

A machine is described for accurately elevating and aligning large ceiling panels for placement in an overhead ceiling. The machine includes a frame supported by wheels which permit horizontal transport of the machine between panel receiving and panel placing positions. Elevating outriggers are provided to elevate the frame and wheels at the panel placing location and to partially advance the panel vertically toward placement. A series of elevating stages which are slidably mounted upon guides fixed to the frame elevate the panel to its final elevation for placement. Hydraulic cylinders are provided to elevate the stages. A pair of carriages are provided, mounted on the elevating stages, slidably adjustable along stage frame members, for shifting the panel into transverse and longitudinal alignment for placement. An upper carriage includes a turntable bearing upon which is mounted a base for supporting the panel. Hydraulic motors cause the inner race of the turntable bearing to which the panel-supporting base is fixed to rotate about a vertical axis with respect to the machine, providing angular alignment of the panel for placement. The panel placing machine is particularly suitable for use in confined structures. For example, the panel placing machine is capable of placing large concrete panels into a ceiling in a two-lane tunnel while operating from one lane.

10 Claims, 9 Drawing Figures

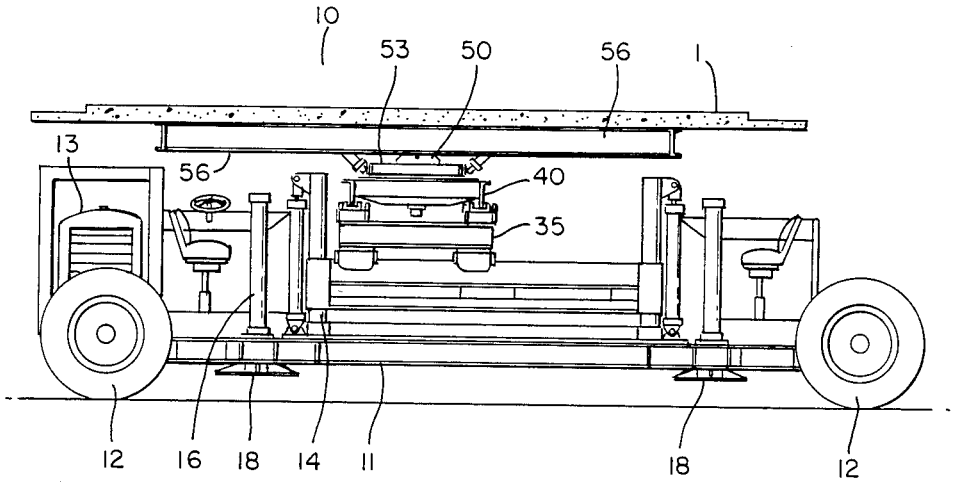
FIG. 1
FIG. 2
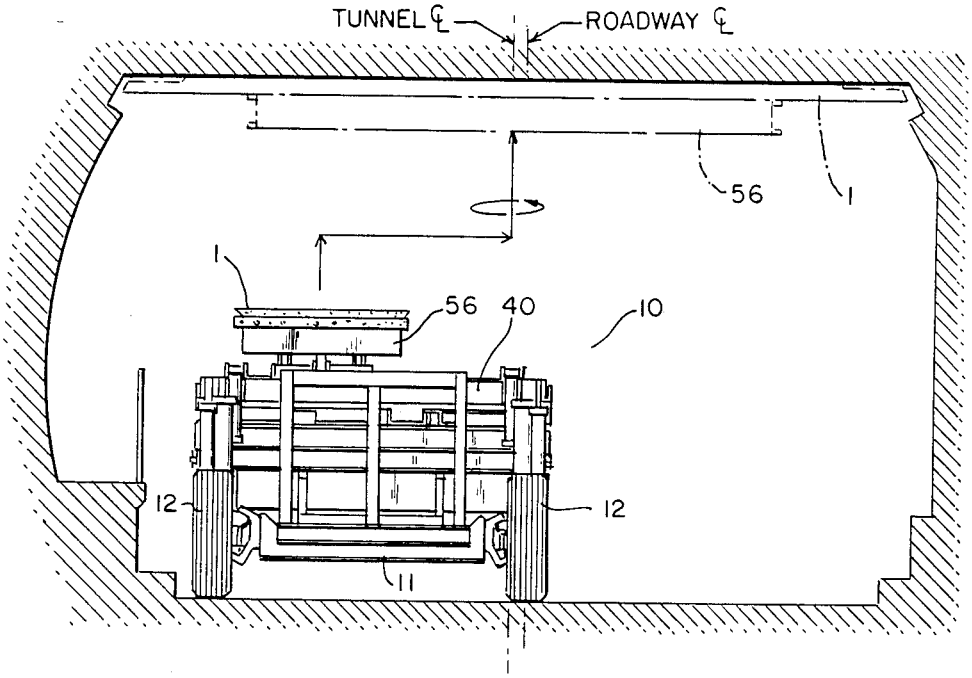

FIG. 7
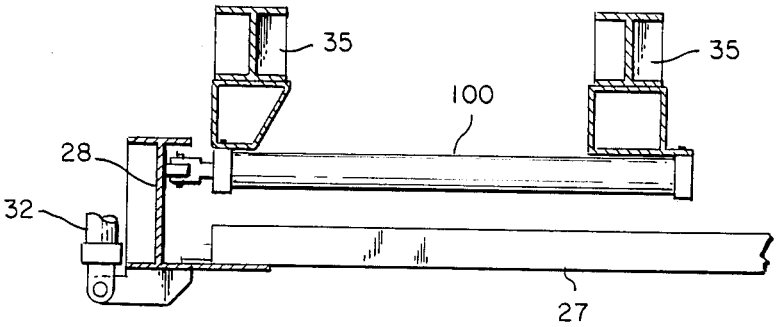
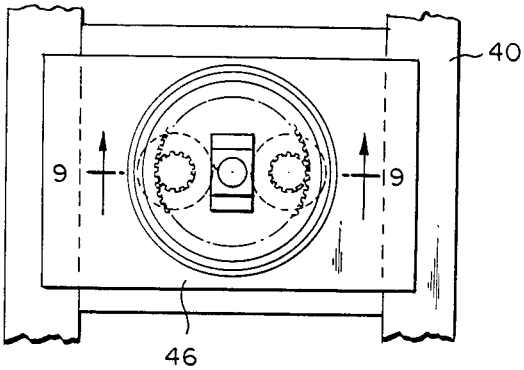
FIG. 8
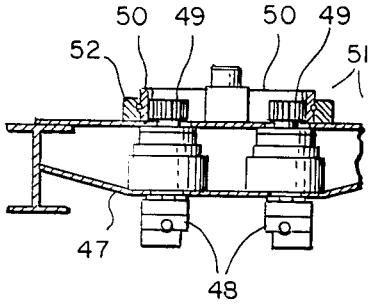
FIG. 9

CEILING PANEL PLACING MACHINE

DESCRIPTION

1. Technical Field

The invention is related to mobile machines for placing heavy components into elevated structures. More particularly, the invention relates to elevating machinery which is able to work in confined spaces and accurately align and place panels into an overhead ceiling.

2. Background Art

It is often necessary to lift heavy and awkwardly shaped objects vertically within a confined workspace and accurately position them for installation. Such a necessity arises, for example, in installing, in parallel alignment, large rectangular ceiling panels to form a suspended ceiling interior to a building or other structure. As the available overhead workspace shrinks, cranes, with their booms elevated above the worksite, become impossible to use. On some jobsites, where turning area is limited, lift trucks of sufficient size to unload and position panels may be unsuitable. In some situations, particularly in working on repair or construction of highways, both unloading of materials and their placement must be confined to a single traffic lane. In some specialized construction, such as in tunnels, both the road width and overhead clearnace limitations greatly restrict the use of equipment heretofore available for such work.

DISCLOSURE OF THE INVENTION

It is an object of the invention to provide a machine for elevating and placing large-dimensioned, generally heavy panels. The panels are typically rectangular in shape and placed, for example, in transverse alignment with respect to the longitudinal axis of the machine.

The machine of the invention receives a panel over the end of a delivery vehicle, wherein said panel is parallel to the longitudinal axis of the machine, with both the delivery vehicle and the machine remaining in a single traffic lane. The machine then moves along the traffic lane to a position suitable for elevation and placement of the panel to form a ceiling which is substantially transverse to the longitudinal orientation of the machine and its supplying vehicle. The machine rotates the panel into transverse alignment for placement and simultaneously shifts the panel to a cantilevered position with respect to the machine, as necessary, for adjusting both the end and transverse alignment of the panel. The machine elevates the panel into horizontal alignment with the ceiling. The panel may be advanced into contact with an earlier installed panel. Final horizontal alignment may be accomplished by adjusting outriggers leveling the machine.

It is an object of the invention to provide a machine preferably having a limited vertical dimension when at rest such that panels may be plaed on the machine from a conventional flatbed delivery vehicle having a central horizontal lifting beam which is generally limited in elevation to conventional truck trailer height or less. The machine is preferably limited in width to the width of a standard traffic lane.

The machine is provided with a frame upon which are mounted wheels and an engine, which allows the machine to transport itself between panel receiving and placing locations. The machine includes outriggers mounted on its frame which elevate the frame and wheels and partially advance the panel vertically toward placement. The frame includes guides for guiding further elevation of the panels. The machine includes a first elevating stage framework having sleeves which slidably fit over the frame guides fixed to the frame. Hydraulic cylinders are affixed to the frame and to the first elevating stage framework to advance the framework vertically, and hence, partially advance the panel vertically toward the ceiling. The machine includes a second elevating stage framework having sleeve members slidably mounted upon the framework sleeves of the first elevating stage. the second stage framework includes longitudinal and transverse framing members. Hydraulic cylinders are affixed to the transverse members between the first and second stages, elevating the second stage framework vertically along the first stage guides.

The machine includes a first carriage, slidably mounted upon the second stage framework longitudinal members, which carriage is capable of shifting the panel longitudinally with respect to the longitudinal axis of the machine. A second carriage, slidably mounted upon a transverse member of the first carriage, permits shifting of the panel transverse to said machine into a cantilevered transverse position. This feature permits end-to-end alignment of the panels where the center line of the placement is offset from the center line of the vehicle. The second carriage also includes a centrally mounted turntable bearing. A panel-supporting table is rotatably mounted on the bearing on the second carriage, wherein the table receives the panels in longitudinal alignment with the machine and rotates the panels into transverse alignment, parallel to its final transverse placement position. The panel-supporting table is pinned to its mounting and includes cylinders which may horizontally level the panel about the rotatable pin connection.

The table rotating system includes, supported on the second carriage, a gear motor driving a pinion gear which engages a gear-toothed annular interior surface of an inner race of a turntable bearing, which has its outer race fixed to said carriage. The table rotating system also includes a table-supporting plate to which the turntable bearing gear inner race is fixed. Rotation of the pinion, engaging the internal gear surfaces, causes the panel-supporting table to rotate from longitudinal through transverse alignment with the machine. The degree of rotation is adjusted to the final panel placement, which is typically in transverse alignment with respect to machine orientation. The table-supporting plate is further connected to the table by means of a pin connection, permitting vertical rotation of the table about said connection, said plate and table further connected by hydraulic cylinders which permit horizontal planar alignment about the pin connection of said panel support table. The machine is capable of further horizontally aligning the ceiling panels by adjusting the machine outriggers.

A unique feature of the machine of the invention is its ability to accept panels from a supply vehicle, move to a panel placing location, and rotate the panel into transverse alignment with respect to the machine and elevate the panel for ceiling installation, all the while remaining in substantial longitudinal alignment with the panel delivery vehicle. The machine is particularly suited for placing ceiling panels where vertical restrictions prevail. For example, the machine is especially adapted to place panels in a tunnel having two lanes of traffic, where placement of the panels must be achieved using only a single traffic lane.

BRIEF DESCRIPTION OF THE DRAWINGS

FIG. 1 is an elevational view of the machine of the invention having just received a panel for placement.

FIG. 2 is a schematic drawing of the panel placing machine preparing to place a panel in a tunnel environment.

FIG. 7 is an end view of the lower carriage, showing the hydraulic cylinder which adjusts panels longitudinally with respect to the longitudinal center line of the machine of the invention.

FIG. 8 is a plan view of the turntable bearing mounting plate.

FIG. 9 shows details of the turntable bearing along sectional lines 9—9.

BEST MODE FOR CARRYING OUT THE INVENTION

Figure 3:
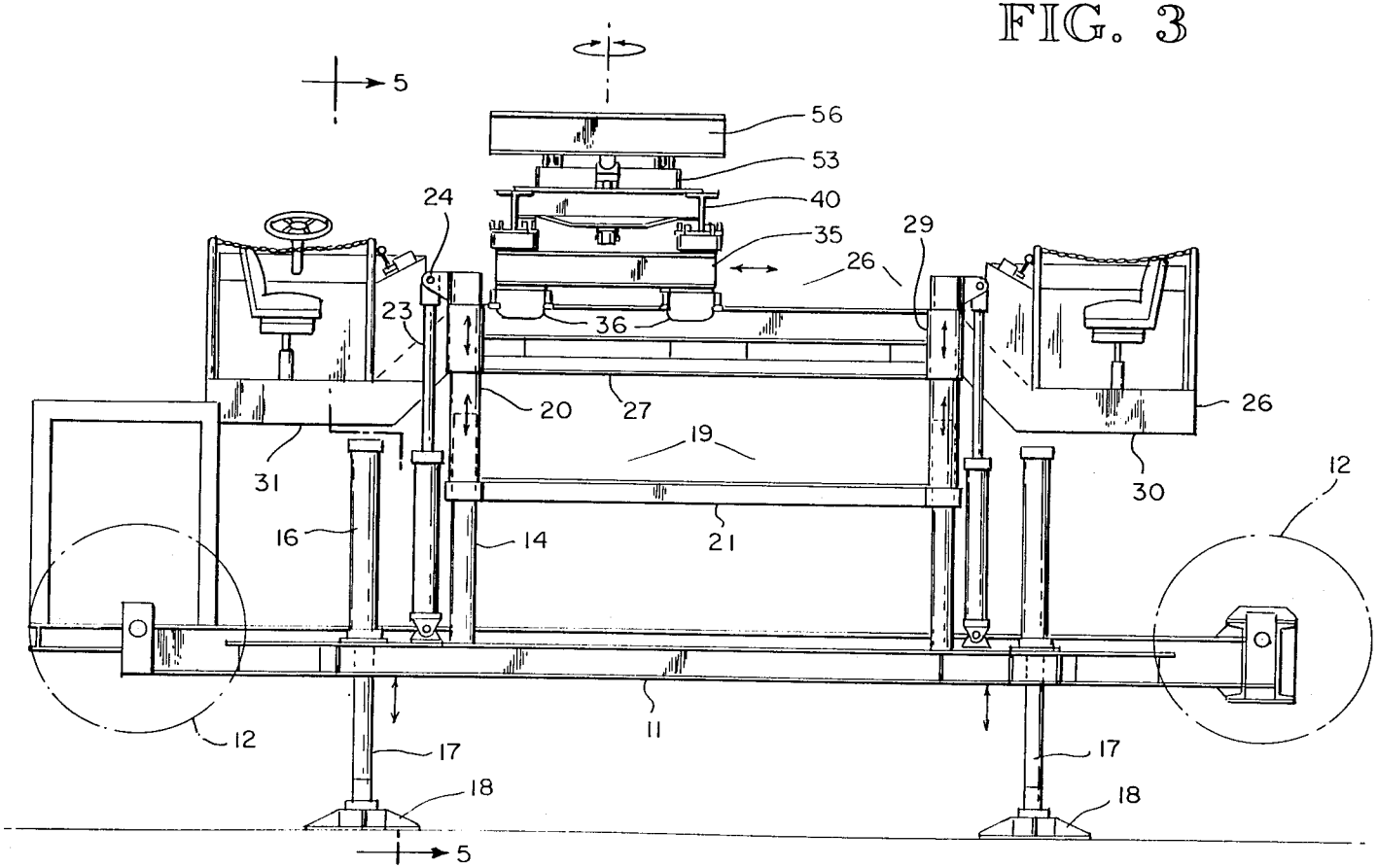
FIG. 3 shows the elevating stages of the panel placing machine and an end view of machine carriages for orienting the panels.

A preferred machine of the invention is suitable, as noted above, for placing panels to form an elevated ceiling of a tunnel. The machine places panels into a ceiling having a center line offset from the longitudinal center line of the machine wherein each ceiling panel is placed substantially transverse to the machine center line.

Referring to FIG. 1, in a preferred embodiment, the panel placing machine 10 is substantially a self-powered vehicle including a truck-type frame 11 supported by wheels 12 and driven by engine 13, which supplies motive power, hydraulic pressure and electrical energy to the machine. The frame is limited in overall width to about a road lane width of about 8–10 feet, as shown in FIG. 2. The height of the vehicle at rest is limited such that panels 1 may be received from a conventional flatbed truck having a central lifting beam. Such beams are generally of no greater height than a conventional trailer. A preferred height for the panel placing machine is about 7–8 feet.

Figure 5:
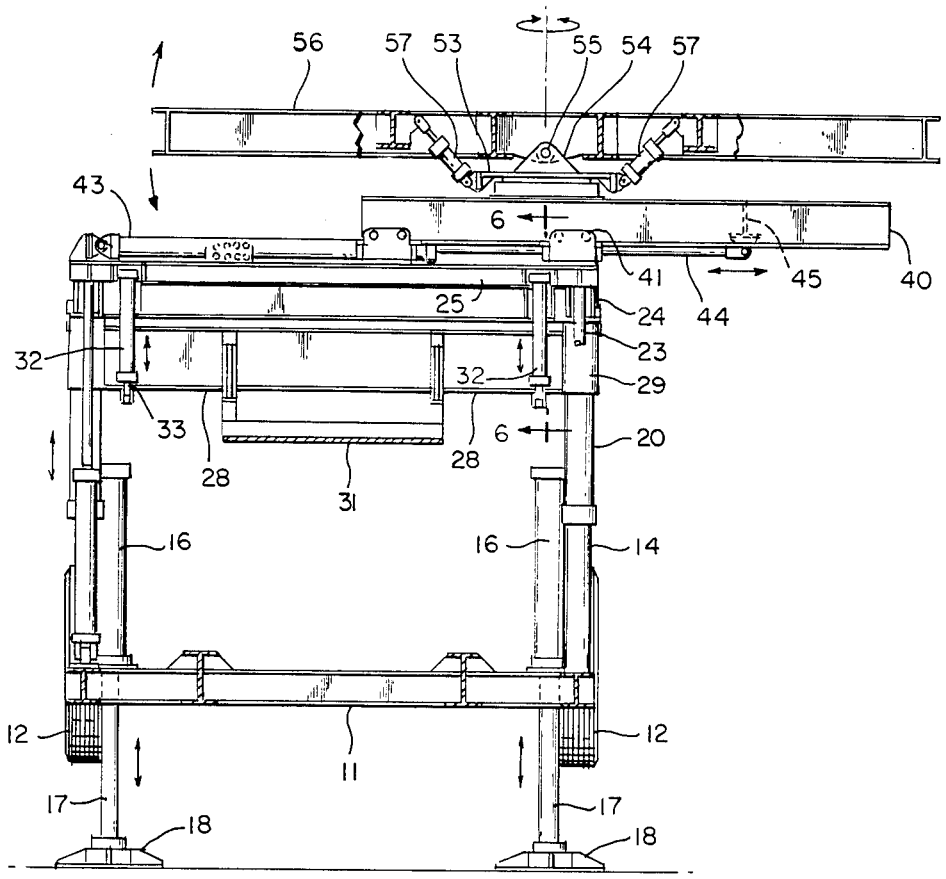
FIG. 5 is an end view of the panel placing machine of FIG. 4.

Referring to FIGS. 3 and 5, the truck frame includes vertical guides 14 fixed to longitudinal frame members 11. The guides provide vertical guidance for additional elevation of the panels 1, as detailed below. Also mounted on frame 11 are four outriggers 16, which, as shown in FIG. 3, provide a stable, level elevation of the frame 11 and wheels 12 from which to place panels, once the machine has been postioned generally below a ceiling section to be worked on. The outriggers are hydraulic cylinders, including a cylinder rod 17 upon which is mounted a bearing plate 18. In addition to ensuring a level platform from which to align the panels, the outriggers also provide a portion of the panel elevation necessary to achieve placement of the panel, permitting limitation of the overall height of the machine.

In addition to the elevating outriggers, the panel placing machine includes two additional elevating stages to take the panel to its final elevation. The first elevating stage 19 includes vertical sleeve members 29 which are slidably mounted on guides 14. The first elevating stage includes a lower longitudinal spreader or bracing member 21. The first stage 19 includes upper transverse bracing members 25. Hydraulic cylinders 22 are fixed to the frame 11, with the cylinder rod 23 fastened to the top of the transverse brace 25 by pin connector 24.

Figure 6:
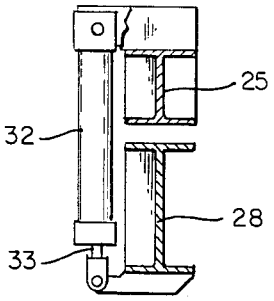
FIG. 6 shows the hydraulic cylinder means for elevating the second elevating stage.

The machine includes a second elevating stage 26, which includes a rectangular framework having longitudinal members 27 and transverse members 28, as well as cross-bracing. The second elevating stage includes vertical sleeve members 29, which are slidably mounted on the first elevating stage vertical slide members 20. The framework of the second elevating stage 26 includes two extensions 30 and 31 which provide supporting bases for operating stations at each end of the machine. These stations, as shown in FIGS. 1 and 3, are somewhat offset in elevation from the central portion of the elevating stage. Hydraulic cylinders 32 are provided to elevate the second stage. As shown in FIGS. 5 and 6, the cylinders are fixed to the top of the first stage cross-member 25. The cylinder rod 33 is fixed to the bottom of transverse beam 28 of the second elevating stage 26. The cylinder rods 33 are extended when the second stage is lowered.

The machine includes a first, lower carriage 35 mounted upon second elevating stage longitudinal member 27. The carriage 35 is slidably mounted by means of rollers 36, which are preferably endless roller chains, Flat-Top Rollers, Model 5XOT, including side-mounted cams which guide the bearing along its supporting beam, manufactured by Hilman Equipment Co., Inc. of Wall, N.J. 07719. The carriage 35 is rectangular in cross section, having transverse members **35*a* and longitudinal members 35*b*. The carriage 35 allows longitudinal (with respect to the ceiling panels which are transverse to the tunnel center line) positioning and adjustment of the panel during final placement. The carriage 35 is longitudinally adjusted by means of a substantially horizontal hydraulic cylinder 100 fixed to the base of the carriage 35 and second stage member 28, as shown in FIG. 7**.

The machine includes a second, upper carriage 40 which is slidably mounted by means of Hilman Rollers 41 upon the transverse member **35*a* of the lower carriage 35. A hydraulic cylinder 43 is fixed to the transverse member 32*a* of the lower carriage and includes rod 44, fixed to cross-bracing 45 of the upper carriage 40. Extension of the hydraulic cylinder causes the carriage 40 to move transversely to the machine center line, cantilevering the center line of the carriage and panel to be placed from the center line of the machine. This feature permits the ceiling panel placing machine to operate offset of the center line of the ceiling placing project. Thus, in the two-lane tunnel project depicted in FIG. 2**, the panel placing machine may operate from one lane, although the center line of the ceiling is offset to substantially the dividing line between the two traffic lanes.

Referring to FIGS. 8 and 9, the upper carriage 40 includes a mounting plate 46 and structural member 47 for supporing a pair of hydraulic gear motors 48. Each motor 48 drives a pinion gear 49, which engages a gear-toothed annular interior surface, which comprises an inner race 50 of a turntable bearing 51. The upper carriage plate 46 provides support for the mounting hydraulic motors' pinions in meshing contact with the bearing inner race 50. The outer race 52 of the turntable bearing 51 is bolted (bolts not shown) to the plate 46, which is fixed to the longitudinal members of the upper carriage 40. Upon rotation of the pinions 49, the inner race 50, having teeth engaged by the hydraulic motor pinions, rotates.

Figure 4:
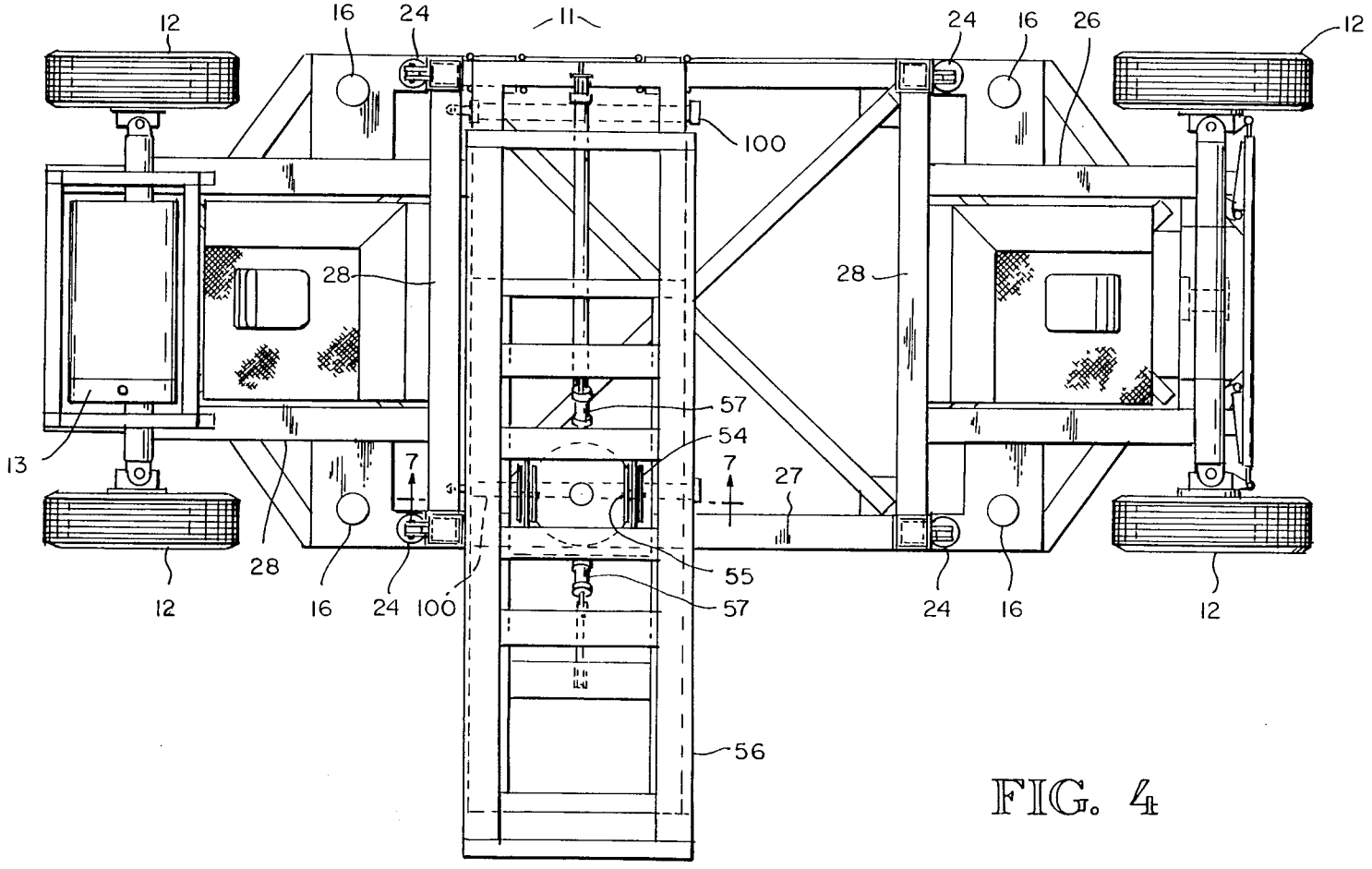
FIG. 4 is a plan view of the panel placing machine of the invention, with the upper carriage cantilevered from the center line of the machine.

The top surface of the inner race 50 of the turntable bearing 51 is fixed to the underside of a table-supporting plate 53, best shown in FIG. 5. The supporting plate includes a pin connection 54 for mounting, by means of pin 55, to a table support 56 for directly supporting the panel to be placed into the ceiling. The table panel support 56 is a substantially rectangular framework having sufficient dimensions to support the ceiling panel to be placed. Hydraulic cylinders 57 connect the supporting plate 53 with the table panel support 56, whereupon horizontal alignment of the panel is achieved by adjusting these hydraulic cylinders about the pivot connection 54. FIGS. 4 and 9 shown that when the hydraulic gear motors are activated to turn turntable bearing inner race 50, the table panel support 56, and hence the panel, rotate about a vertical axis with respect to the panel placing machine. Thus, angular adjustment of the panel with respect to placement in a ceiling substantially transverse to the machine is provided.

In operation, a supply vehicle carrying a load of reinforced concrete ceiling panels, which, for example, are 15–24 feet long and 2–8 feet wide and weigh on the order of 4 tons each, is backed near an end of a panel placing machine. The supply vehicle and machine are substantially in longitudinal alignment, as in a single traffic lane. The panel placing machine approaches the panel supply vehicle with all machine-elevating mechanisms adjusted so that the table support 56 for receiving a panel is at its lowest elevation, as shown in FIG. 1. The panel is elevated on the supply vehicle by means of a central lifting beam, advanced over the panel-supporting table 56, and lowered onto the table. At this point, the panel is in longitudinal alignment with the supply vehicle and the panel placing machine. The machine lies substantially perpendicular to and offset from the center line of the final placement of panels in a ceiling, as shown in FIG. 2.

The panel placing machine is then advanced until the panel is substantially directly under its final placement location, althrough still offset from the ceiling center line, since it typically must remain in a single road lane to permit traffic to pass. The outriggers of the panel placing machine are lowered and the truck frame and wheels elevated, as necessary with respect to the overall height of the ceiling and to provide a level platform from which to further elevate the ceiling panel. The outriggers do not necessarily level the machine but make sure that the machine is parallel to the plane of the ceiling. The second elevating stage 26 is then lifted from its lowered position. In the embodiment shown in FIGS. 5–6, this elevation requires retracting hydraulic cylinders 32 until the second elevating stage reaches its maximum elevation. Elevating the second stage raises the operating platforms, permitting the operator an elevated view of the subsequent operations. The partially elevated panel is next turned to align the panel in parallel with the ceiling and cantilevered until the panel is centered on the center line of the ceiling. These operations are conducted simultaneously with care to ensure that the panel does not strike any confining structure or walls.

The first elevating stage is then activated by means of hydraulic cylinders 22, which stage takes the panel to its final elevation. Horizontal alignment (transverse to the machine) may be trimmed by means of hydraulic cylinders 57, which adjust the horizontal trim of the panel-supporting table 56. The fore and aft (with respect to the machine) horizontal trim of the panel is achieved, for example, by adjusting fore and aft outrigger hydraulic cylinders 16. Finally, the lower carriage 35 may be moved forward into final position, for example, to abut the elevated panel with the previously placed panels. The panel placing machine of the invention then reverses its elevation and rotation sequence, finally raising its outriggers and returning to the supply vehicle for the next panel.

The hydraulic system of the panel placing machine is comprised of two independent hydraulic circuits, including an "implement" (panel elevating and orientating) circuit and a "propel" (transport) circuit. The power source for both circuits is provided by the diesel engine 13.

The propel or mahcine transporting circuit is a hydrostatic propel system comprising a variable displacement cross center hydraulic pump powering four each constant displacement wheel motors. The wheel motors are spindle mounted, which enables steering of independent wheel pairs about their respective axles. A remote displacement control unit adjusts the pump displacement by varying an electrical signal. One displacement control unit is mounted in each of the two operators' stations so that separate control can be provided from either operator's station. Pneumatic drum-type brakes are fitted onto the wheel motors to provide an emergency braking system.

The implement circuit pump is a variable displacement, pressure-compensated pump which provides hydraulic power to all functions of the machine, such as panel elevation and rotation, except propel. One control valve for each function is mounted in each of the two operators' stations so that separate control can be provided from either operator's station. Full independent control by one of the two operators' stations is ensured by means of the station select valve. This valve directs hydraulic power to one of the stations, while simultaneously disabling the other station, preventing interruptions to function operation.

We claim:

1. A machine for elevating and placing panels, comprising:

a frame supported by wheels permitting horizontal transport of said machine between panel recieving and panel placing positions, said frame including guides for guiding vertical elevation of said panels;

a plurality of outriggers, mounted upon said frame extendible downwardly to elevate, at a panel placing location, said frame and said wheels, and to partially advance said panel vertically toward placement;

a first elevating stage including sleeve members, slidably mounted upon said frame guides, said stage elevatable on said guides to partially advance said panel vertically toward placement, said first stage framework including longitudinal and upper transverse, with respect to said machine, supporting members;

elevating means affixed to said frame and attached to the first elevating stage to advance said stage vertically;

a second elevating stage having sleeve members slidably mounted on said guide sleeve members of said first elevating stage, said second stage having longitudinal and transverse supporting members;

elevating means, affixed to transverse members between said first and second stages, for elevating said second stage vertically along said first stage guides;

a first carriage, mounted on and slidably adjustable along said second stage longitudinal members, for shifting said panel into an approximate longitudinal placement location;

a second carriage, mounted on and slidably adjustable upon a transverse member of said first carriage, for shifting said panel transversely to said machine and into cantilevered transverse alignment with the center line of said panel placement, said carriage including a substantially centrally mounted, rotationally adjustable turntable bearing; and a panel-supporting table rotatably mounted upon said second carriage bearing, said table receiving panels in longitudinal alignment with said machine and rotating said panels into alignment for panel placement location, wherein the elevating stages elevate the panel to its placement level and the carriages shift and rotate said panel into transverse, end-to-end alignment for placement.

2. The machine of claim 1 wherein said rotatable panel-supporting table includes, supported on said second carriage, a gear motor driving a pinion which engages a gear-toothed annular interior surface of an inner race of a turntable bearing, said outer race of said bearing fixed to said second carriage; and a table-supporting plate to which said turntable bearing inner race gear is fixed, said plate fixed to said panel support table, wherein rotation of said pinion engaging said gear inner race causes said gear-toothed bearing inner race, and hence said panel-supporting table and panel, to rotate from longitudinal through transverse alignment with said machine, said rotation adjustable until said panel is in alignment for placement.

3. The machine of claim 2 wherein said table-supporting plate is fixed to said table by means of a pin connection permitting vertical rotation of said table about said connection, said plate and table connected by hydraulic cylinders which horizontally trim said panel about said pin connection into planar alignment for placement.

4. The machine of claim 1 wherein said machine includes further vertical alignment of said panel at final placement, including means for independently adjusting the elevation of transverse and longitudinal pairs of outriggers.

5. The machine of claim 1 wherein said panels are substantially rectangular in shape and are components of an elevated ceiling.

6. The machine of claim 1 wherein placement of said panels forms a suspended ceiling for a two-traffic lane vehicular tunnel, said ceiling substantially transverse to the longitudinal center line of said tunnel and all panel receiving and placement are performed from a single traffic lane.

7. The machine of claim 2 wherein elevating and rotating said panels into alignment for placing are achieved by hydraulic pressure means.

8. The machine of claim 2 wherein all elevating means are hydraulic cylinders.

9. The machine of claim 1 wherein said second elevating stage includes operating stations at both ends of said machine, each station including separate hydraulic controls for said machine, only one station of which is operable at a given time.

10. The machine of claim 1 wherein said panels are placed into a ceiling including panels that are substantially perpendicular to the longitudinal center line of said machine.

* * * * *